United States Patent [19]

Mello et al.

[11] Patent Number: 5,054,266

[45] Date of Patent: Oct. 8, 1991

[54] VACUUM SEAL STATION FOR A VACUUM PACKAGING MACHINE

[75] Inventors: Frank C. Mello, Zeeland, Mich.; Ihor Wyslotsky, Chicago, Ill.

[73] Assignee: Bil-Mar Foods, Inc., Zeeland, Mich.

[21] Appl. No.: 516,452

[22] Filed: Apr. 30, 1990

Related U.S. Application Data

[63] Continuation of Ser. No. 239,517, Sep. 1, 1988, abandoned.

[51] Int. Cl.[5] ..... B65B 31/00

[52] U.S. Cl. ..... 53/433; 53/436; 53/487; 53/511; 53/526

[58] Field of Search ..... 43/432, 433, 436, 487, 43/510, 511, 526, 527

[56] References Cited

U.S. PATENT DOCUMENTS

| | | | |
|---|---|---|---|
| 3,478,488 | 11/1969 | Jensen | 53/510 |
| 3,498,018 | 3/1970 | Seiferth | 53/433 |
| 3,971,188 | 7/1976 | Cawrse | 53/487 X |
| 4,034,536 | 7/1977 | Mahaffy | 53/433 |
| 4,154,044 | 5/1979 | Lang | 53/510 X |
| 4,167,092 | 9/1979 | Medwed | 53/511 |
| 4,201,030 | 5/1980 | Mahaffy | 53/510 X |
| 4,411,122 | 10/1983 | Cornish | 53/526 X |
| 4,684,025 | 8/1987 | Copland | 53/526 X |

*Primary Examiner*—John Sipos

*Attorney, Agent, or Firm*—Allegretti & Witcoff, LTD.

[57] ABSTRACT

A vacuum packaging machine includes an elongated frame, packaging forming stations for forming a lower container and top or cover for a package, a vacuum seal and sizing station, a chill station and a cutoff or package separating station. The vacuum seal and sizing station includes an upper tool defining an upper chamber and a lower tool defining a container chamber. The lower tool is movable towards and away from the upper tool and defines a vacuum chamber therewith. A pressure and sealing bar disposed within the upper chamber is movable to seal the package top to the container. A platform is adjustably positionable in the container chamber to vary the volume or size of the vacuum chamber. A product sizing plunger carried by the upper tool engages and compresses the product placed within the container prior to application of a vacuum and sealing of the cover or top to the container.

31 Claims, 9 Drawing Sheets

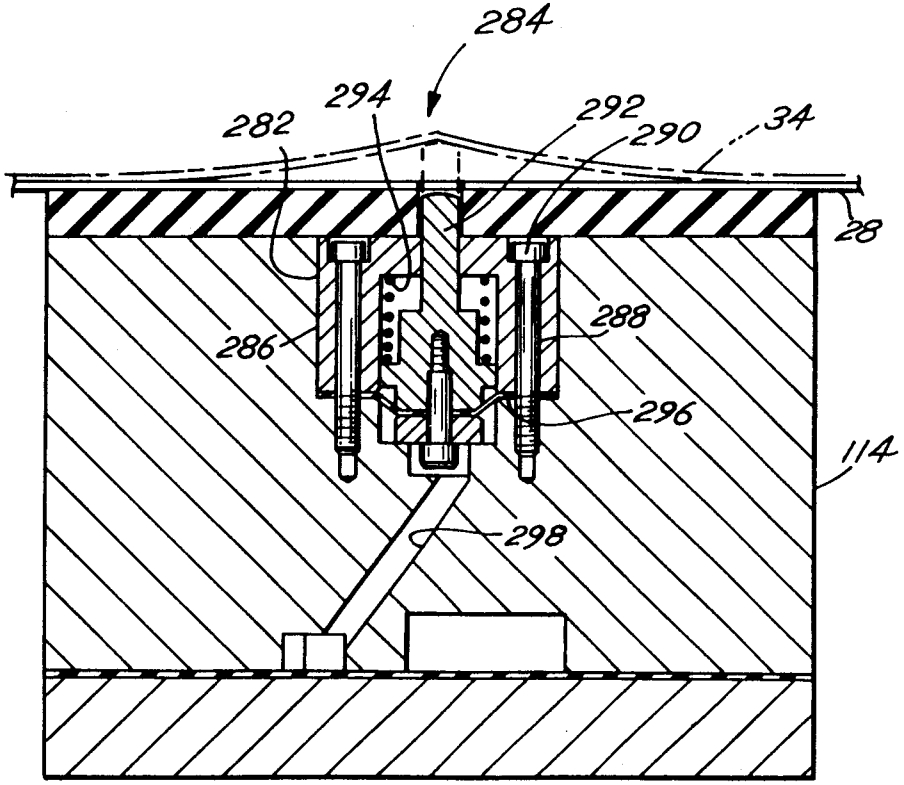
Fig. 9
Fig. 10
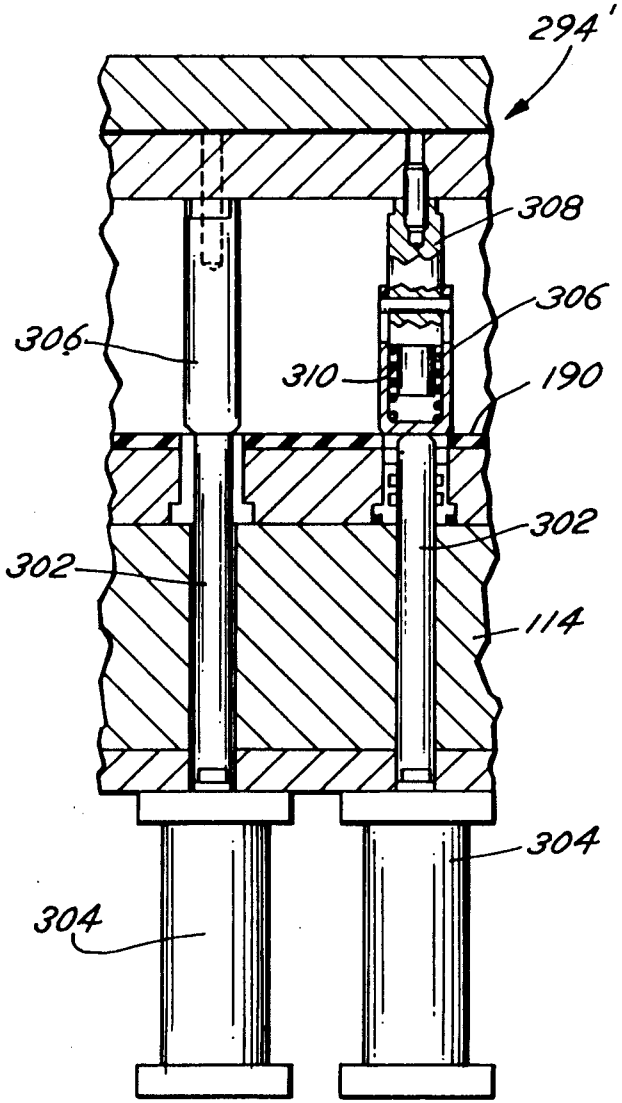

Fig. 12
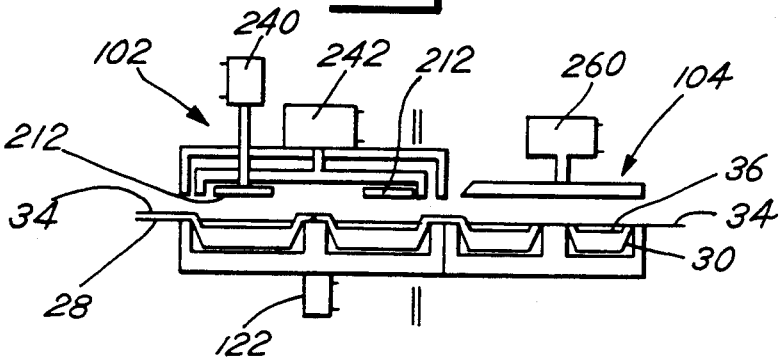
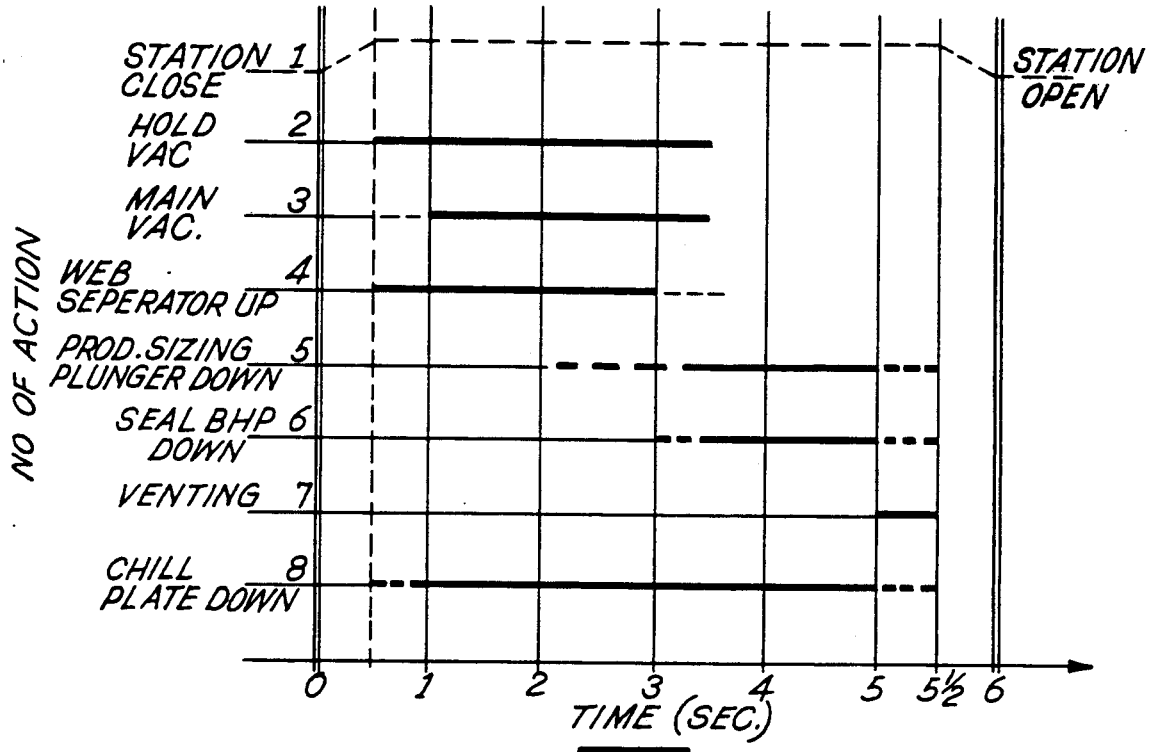
Fig. 14

VACUUM SEAL STATION FOR A VACUUM PACKAGING MACHINE

This is a continuation of application Ser. No. 239,517, filed Sept. 1, 1988, now abandoned. cl BACKGROUND OF THE INVENTION The present invention relates to vacuum packaging machines and more particularly to a vacuum seal station for such machines.

A wide variety of comestible or food products are shipped in see-through, plastic packaging. If the packaging is of the rigid-rigid type, it will include a rigid container or tray portion and a rigid plastic or foil top or cover. The cover is sealed to the container. Many products such as cheese, bologna, ham slices, turkey slices and the like are vacuum packaged to improve shelf life. Air is withdrawn from the package before the cover and container are sealed. An example of one such package may be found in U.S. Pat. No. 4,427,705 entitled COMESTIBLE PACKAGE and issued on Jan. 24, 1984 to Wyslotsky et al. The package disclosed therein includes a bottom member which defines a plurality of congruent corrugations. The bottom member may flex upwardly or downwardly against the food product to provide a substantially snug fit of the product within the package. A top member includes a plurality of circumferential and longitudinal corrugations which increase resistance to longitudinal compression. The package is designed to reduce excessive space within the package. This increases the ease of vacuumizing and minimizes leakage of air into the package.

Typical vacuum packaging machines or apparatus include a main frame which supports a first web of packaging material. The first web of packaging material is conveyed through a plurality of work stations. Generally, a package forming station is provided to form the container portion of the package. The web with the container portion formed is then moved into a vacuum and seal station. A second web of packaging material supported on the main frame is moved into registry with the first web within the vacuum and seal station. Within the station, a vacuum is applied to remove air from the container and the second web is sealed to the first web. The joined webs are then moved to a cutoff station. Examples of vacuum packaging machines may be found in U.S. Pat. No. 3,979,877 entitled VACUUM PACKAGING MACHINE WITH WEB REGISTRATION MEANS and issued on Sept. 14, 1976 to Vetter and U.S. Pat. No. 3,992,850 entitled APPARATUS FOR PACKING MATERIALS IN SYNTHETIC FOILS and issued on Nov. 23, 1976 to Vetter. An example of a cutoff station for separating rows of packages formed on the continuous webs or bands may be found in U.S. Pat. No. 3,848,492 entitled APPARATUS FOR LONGITUDINALLY SEPARATING SERIALLY PRODUCED SYNTHETIC-RESIN PACKAGES and issued on Nov. 19, 1974 to Vetter.

Presently available vacuum and seal stations typically include an upper tool which is fixed to a frame and a lower tool which is movable towards and away from the upper tool. The tools define a vacuum chamber. A resilient anvil is positioned around the peripheral edge of the lower tool. The upper tool engages the anvil to seal the chamber. In use, comestible product is loaded into the tray or container portion of a package which is then moved into the vacuum and seal station. The top or cover portion of the package is moved into registry with the container and the tools are closed. The package is evacuated and a pressure seal bar is moved into contact with the periphery of the package to seal the components together. Generally, a heat and pressure actuated adhesive is employed. Examples of prior seal stations may be found in U.S. Pat. No. 4,296,588 entitled SEALING STATION OF VACUUM PACKAGING MACHINE and issued on Oct. 27, 1981 to Vetter and U.S. Pat. No. 4,167,092 entitled SEALING DEVICE FOR PACKAGING and issued on Sept. 11, 1979 to Medwed.

With a wide variety of products such as ham, bologna, turkey slices and the like, the product is initially formed into a cylindrical loaf. The loaf is sliced into a plurality of generally circular slices. A stack of the slices are positioned within the package. Due to variations in the diameter of the food product and/or height of the stack, the package may not be snugly filled. When the vacuum is drawn on the product, canning may occur. In effect, the container portions which do not engage the product will buckle when the vacuum is applied. Canning reduces the appearance of the product and container. In addition, leakage may occur at the buckled areas. A need exists, therefore, for a vacuum packaging machine and more particularly a vacuum seal station which will compensate for food product size variations and insure that the container is snugly packed to reduce free air space, eliminate canning and minimize the occurrence of leaking packages.

SUMMARY OF THE INVENTION

In accordance with the present invention, a unique vacuum seal station for use in a vacuum packaging machine is provided whereby the aforementioned needs are met. Essentially, the station includes upper and lower tools which define a vacuum chamber. A sealing bar, disposed within the chamber, is movable into engagement with an upper web positioned in registry with a lower web which defines a container. Provision is made for compressing the food product within the chamber to achieve a snug fit and eliminate air space. In the preferred form, a movable platform is provided within the lower tool. The platform is adjustable to vary the volume of the chamber. A product sizing tool engages and compresses the food product within the container. The sizing tool insures that the product is snugly disposed within the container to eliminate or minimize canning and the occurrence of leakage.

BRIEF DESCRIPTION OF THE DRAWINGS

FIG. 9 is a cross-sectional view taken generally along line IX—IX of FIG. 8 illustrating a web separator incorporated in the seal station;

FIG. 10 is a fragmentary, cross-sectional side elevational view illustrating an alternative web separator;

FIG. 12 is a schematic illustrating the operation of the seal and chill station in accordance with the present invention;

FIG. 14 is a timing chart showing the sequence of operation of the seal and chill station in accordance with the present invention.

DETAILED DESCRIPTION OF THE PREFERRED EMBODIMENT

Figure 1:
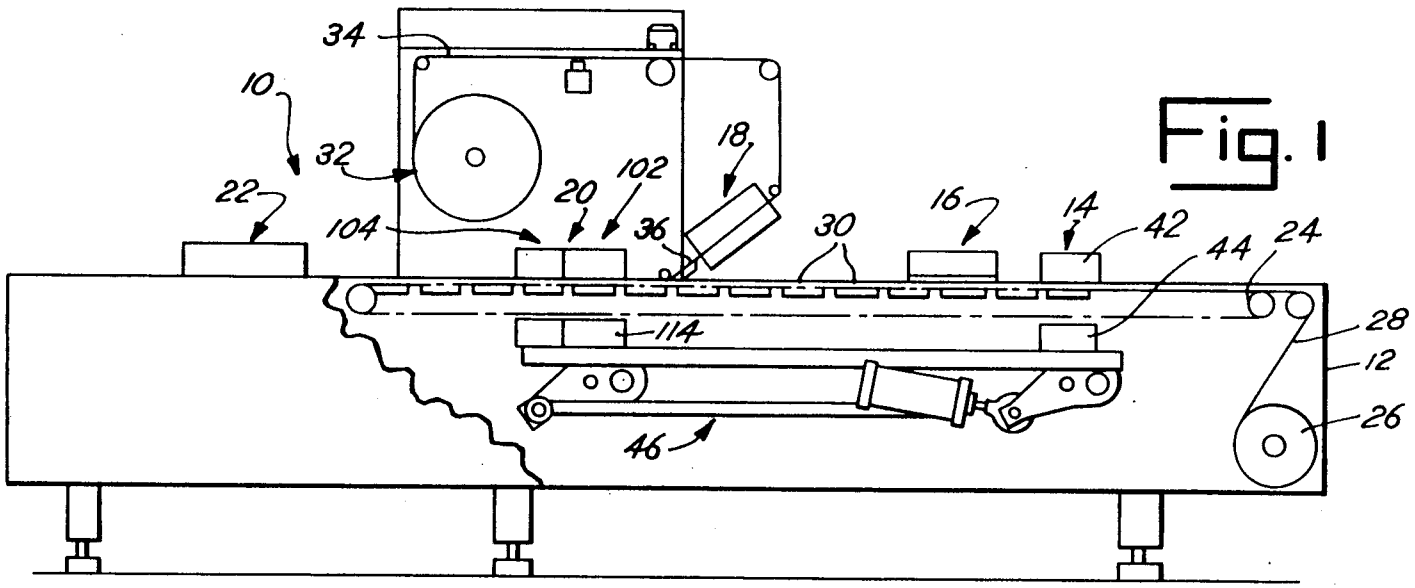
FIG. 1 is a side, elevational view schematically illustrating a vacuum packaging machine incorporating a seal station in accordance with the present invention.

A vacuum packaging machine incorporating a sealing station in accordance with the present invention is schematically illustrated in FIG. 1 and generally designated by the numeral 10. Machine 10 includes a main frame 12. A container or tray forming station 14, a product loading station 16, a lid or cover forming station 18, a seal and chill station 20 and a cutoff station 22 are positioned along frame 12. A roll of film or sheet material 26 is mounted at a forward end of frame 12. Web 28 of roll 26 is conveyed through machine 10 by conveyor 24 in a conventional fashion. At station 14, lower containers or trays 30 are formed in the continuous web of material. Station 14 is a conventional vacuum or thermo-forming apparatus. Examples of such forming stations may be found in U.S. Pat. No. 4,521,175, entitled APPARATUS FOR PRODUCING CONTAINERS FROM THERMOPLASTIC SHEET MATERIAL, issued on June 4, 1985 to Medwed and U.S. Pat. No. 4,162,884, entitled APPARATUS FOR SHAPING PLASTICS FOILS, issued on July 31, 1979 to Vetter. At station 16, product is loaded into containers 30 formed in web 28. The loading operation may be manual or automatic. A second roll 32 of sheet material 34 is supported on frame 12. Material 34 passes through forming station 18, at which lids 36 are formed in the web. Station 18 is of conventional design. At station 20, lids 36 are placed in registry with the filled containers 30. Within station 20, a vacuum is applied, lids 36 are sealed to the containers or trays 30 and the area of the heat seal is chilled or cooled. At station 22, the plurality of sealed packages are separated from each other in a conventional fashion.

As shown in FIG. 1, station 14 may include an upper tool 42 and a lower tool 44. Various devices may be provided to move the tools towards and away from each other to permit the formed containers to be advanced along the machine. A mechanical linkage arrangement 46, as shown, is one example. Conventional hydraulic or pneumatic piston cylinder units may also be used.

Figure 2:
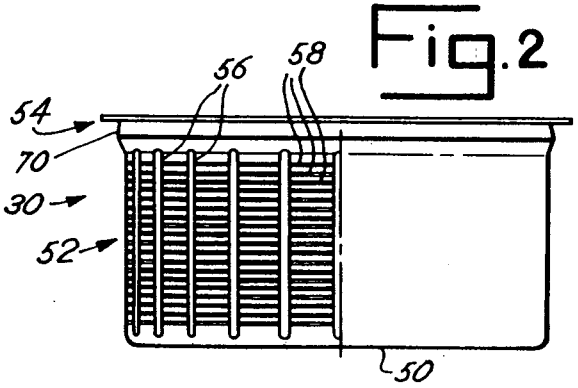
FIG. 2 is a side, elevational view of a tray or container portion of a package produced by the apparatus of FIG. 1.
Figure 3:
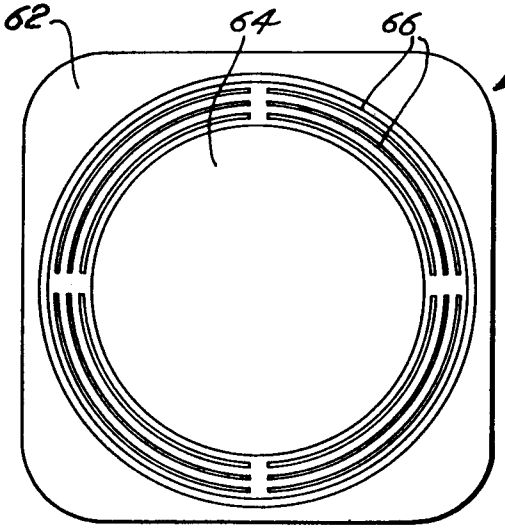
FIG. 3 is a top, plan view of a lid or cover portion of the package.
Figure 4:
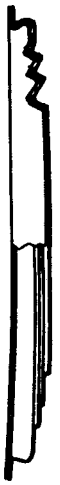
FIG. 4 is a side, elevational view of the lid of FIG. 3.

Apparatus 10 fabricates a package including a tray or container 30, illustrated in FIG. 2, and a lid or cover 36, illustrated in FIGS. 3 and 4. Container 30 is generally cylindrical in shape and includes a bottom 50, a sidewall 52 and an upper peripheral flange 54. Container 30 is formed at station 14 from a "rigid" plastic conventionally used for packaging of food products. Sidewall 52 includes a plurality of vertical corrugations 56. Corrugations 56 increase the resistance of container 30 to longitudinal compression. In addition, a plurality of corrugations 58 extend in spaced parallel relationship circumferentially around sidewall 52.

Cover 36 is formed at station 18 from a metallized film or foil material. As shown in FIGS. 3 and 4, cover 36 includes a peripheral flange 62 and a central, circular portion 64. Circular portion 64 is joined to peripheral flange 62 by a plurality of congruent, coaxially positioned corrugations 66. Corrugations 66 define a bellows-like structure permitting central portion 64 to move towards and away from flange 62. An annular portion 68 (FIG. 4) joins the corrugated portions 66 to flange 62. Annular portion 68 is configured to be received in a complementarily formed upper portion 70 of container 30. In the completed package, flange 62 of cover 36 is adhesively joined to flange 54 of container 30. The undersurface of the metallized film or foil 36 is coated with adhesive which is fusing polymer. A suitable adhesive for use in forming packaging of the type under consideration is well known in the industry.

A seal and chill station 20 in accordance with the present invention is illustrated in FIGS. 5, 6, 7 and 8 and schematically shown in FIG. 12. Station 20 includes a seal subassembly or substation 102 and a chill subassembly or substation 104. In an existing embodiment of apparatus 10, stations 14 and 18 form containers 30 and 36 in tandemly arranged rows of three in the respective web materials 28, 34. Chain conveyor 24 intermittently advances a two row "cutout area" in the webs into station 20.

Station 102 includes side support members 110, an upper tool assembly 112 and a lower tool assembly 114. Chill substation 104 includes an upper tool 116 and a lower tool 118. Tools 114, 118 are moved towards and away from fixed tools 112, 116 by mechanism 46, illustrated in FIG. 1, or by piston cylinder units 122, illustrated in FIG. 8.

Figure 7:
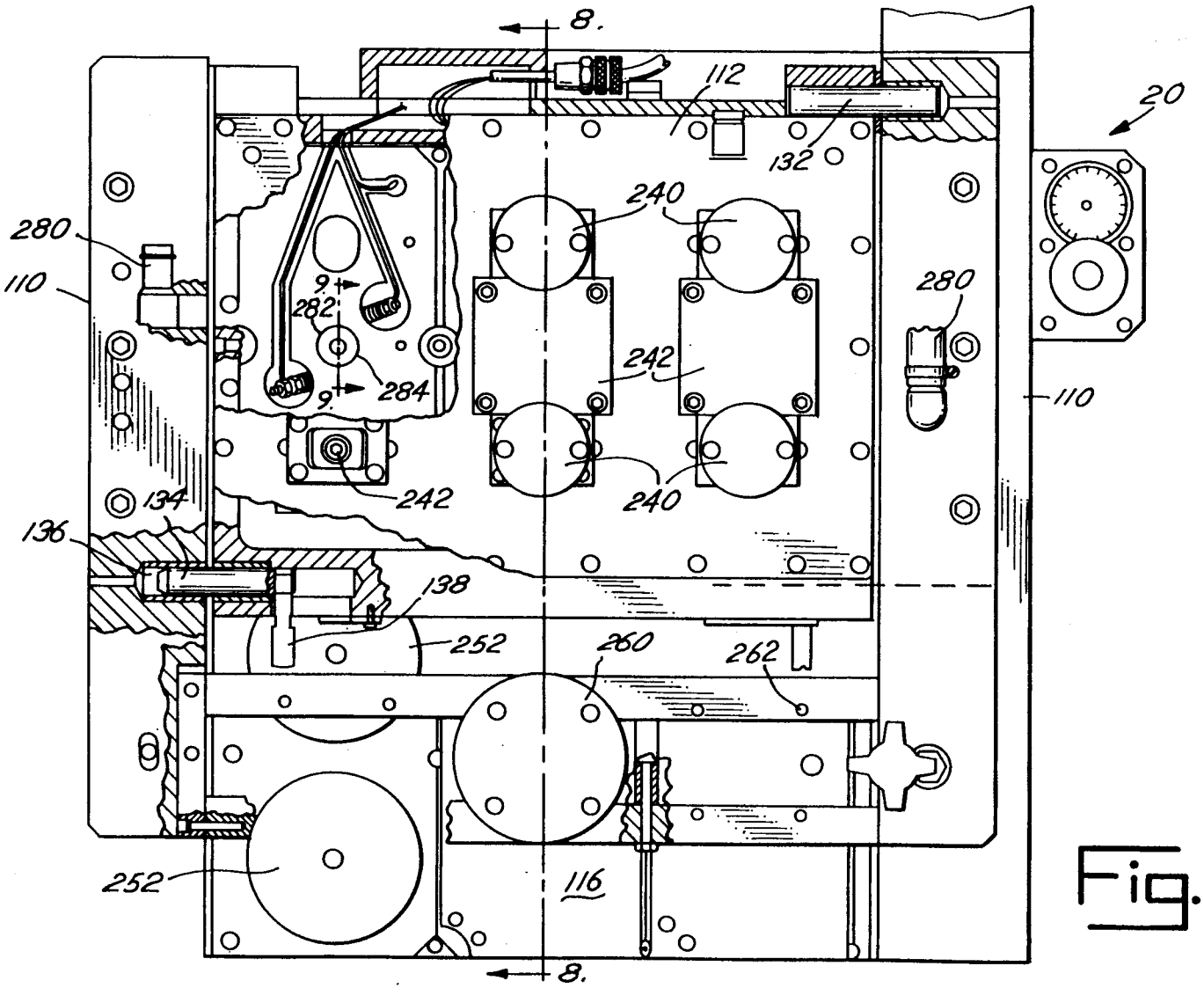
FIG. 7 is a top, plan view of the seal and chill station.
Figure 8:
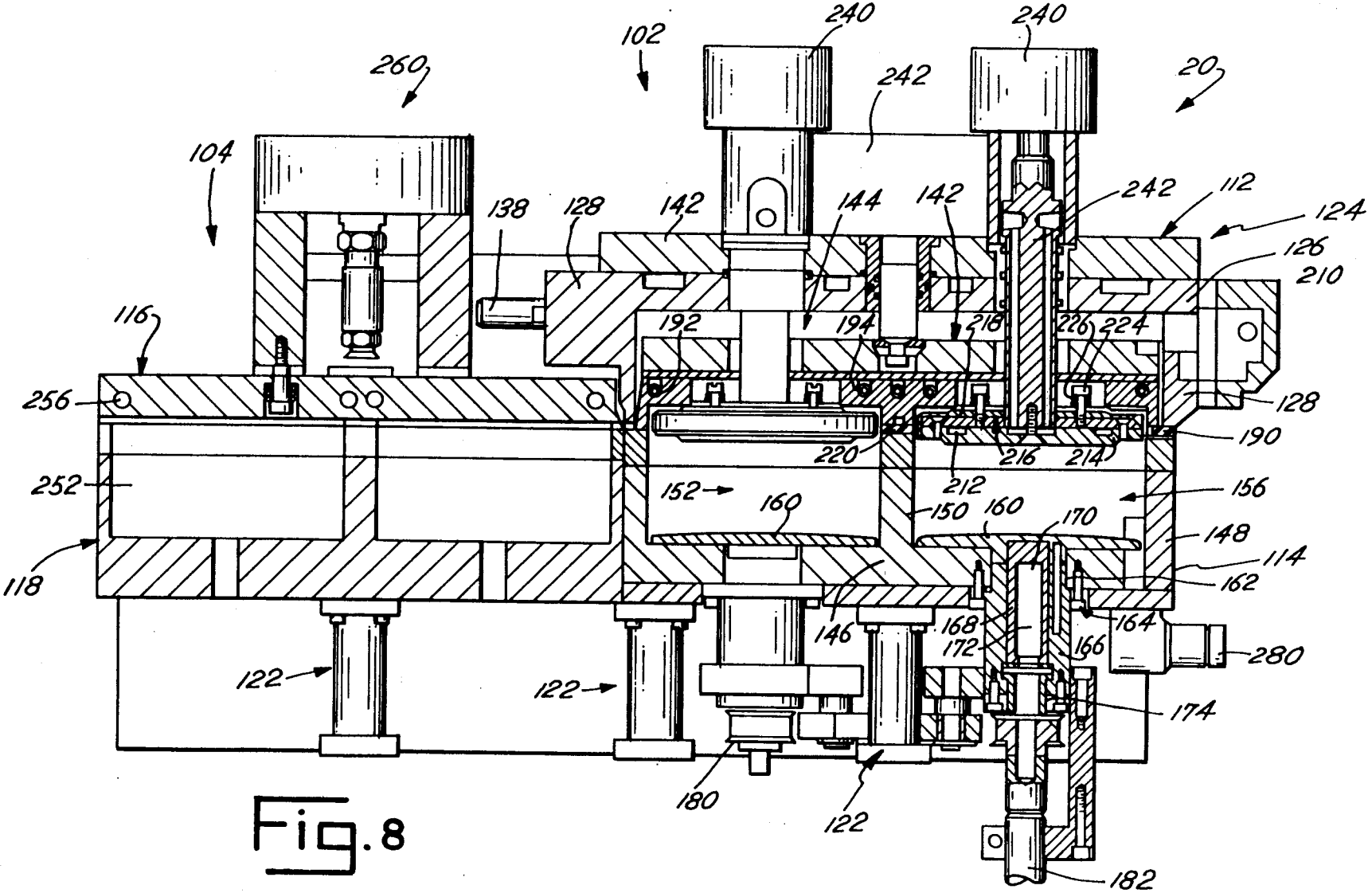
FIG. 8 is a cross-sectional view taken generally along line VIII—VIII of FIG. 7.

Upper tool 112 includes a housing 124 having a top or base portion 126 and sidewalls 128. Housing 124, as seen in FIGS. 7 and 8, is pivoted to side supports 110 by suitable pins 132. A latch pin 134 may be moved within a bore 136 by a handle 138. When in the unlatched position, upper tool 112 may be pivoted upwardly to permit access to the internals of the tooling structure. Mounted on base portion 126 are support plates 142. Housing 124 defines an upper chamber 144. Lower tool 114 includes a base 146, outer walls 148 and inner walls 150. Tool 114 defines six chambers 152 positioned in tandemly arranged rows of three to receive the formed containers 30 of a cutout area.

An adjustable platform 160 is positioned within each chamber 152 of tool 114. Platform 160 has a smoothly curved large radius upper surface. Base 146 defines a bore 162 through which a hub assembly 164 extends. Hub assembly 164 includes an outer hub housing 166 and an inner hub 168. Hub 168 is movable vertically within hub 166 and is press fitted to platform 160. Hub 168 defines an internally threaded bore 170 threadably engaged by a lead screw 172. Screw 172 is rotatably supported within hub 166 by a mounting assembly 174. As screw 172 is rotated, platform 160 is moved upwardly or downwardly within chamber 152. Platform 160 is, therefore, vertically adjustable. As a result, the interior volume of chamber 152 may be adjusted to accommodate the containers as discussed below. A drive pulley 180 is secured to each screw 172. A suitable belt is reeved around each of the pulleys 180 on each screw 172. As a result, rotation of one of the lead screws through a suitable shaft or cable 182 will rotate each of the lead screws. The screws are ganged together by the pulley and belt arrangement.

Extending around the periphery of lower tool 114 and on top of interior walls 140 is a suitable resilient anvil or seal 190. When tools 112, 114 are in the closed position, as illustrated in FIG. 8, upper tool 112 engages anvil 190 to seal the vacuum chamber defined by the upper and lower tools.

A pressure and seal bar subassembly 192 is disposed within chamber 144 of tool 112. Subassembly 192 includes suitable resistance heating elements 194. Tool 192 is generally cup-shaped in cross-sectional configuration and defines pressure surfaces which extend around the peripheries of each of the chambers 152. In conventional fashion, the pressure and seal bar engages the top web of the package and exerts pressure on the top web and the lower web which are sandwiched between anvil 190 and the tool.

A plurality of product sizing plunger subassemblies 210 are disposed within the vacuum chamber defined by the upper and lower tools. Each subassembly 210 includes a central, generally circular piston or plunger 212. Piston 212 includes an annular peripheral surface 214 which is configured to conform generally to lid 36. An annular cup 216 is positioned around central piston or plunger 212. Cup 216 includes a base 218 and a peripheral or annular rim 220. As shown in FIG. 8, bolts or suitable fasteners 224 extend through cup 216 and are secured to an upper surface of central plunger 212. Springs 226 are positioned between member 216 and bolt 224. As a result, member 216 is resiliently biased towards platform 160 within the vacuum chamber.

A plurality of piston cylinder assemblies 240 are supported on mounting plates 142 on upper tool 112. Rods 242 of each assembly 240 are fixed to a respective central plunger 212. A plurality of piston cylinder assemblies 242 engage the pressure and seal bar 144. Assemblies 242 move the pressure and seal bar into engagement with the packaging webs.

Tool 118 of chill substation 104 defines a plurality of chambers 252 (FIGS. 7 and 8). Upper tool 116 defines coolant passages 256 through which a suitable coolant, such as chilled water, is circulated. A piston cylinder actuator 260 supported on a cross piece 262 moves tool 116 towards tool 118. As explained below, the chill plate or tool engages the heated areas or the seal areas between the upper and lower webs of the package.

Figure 5:
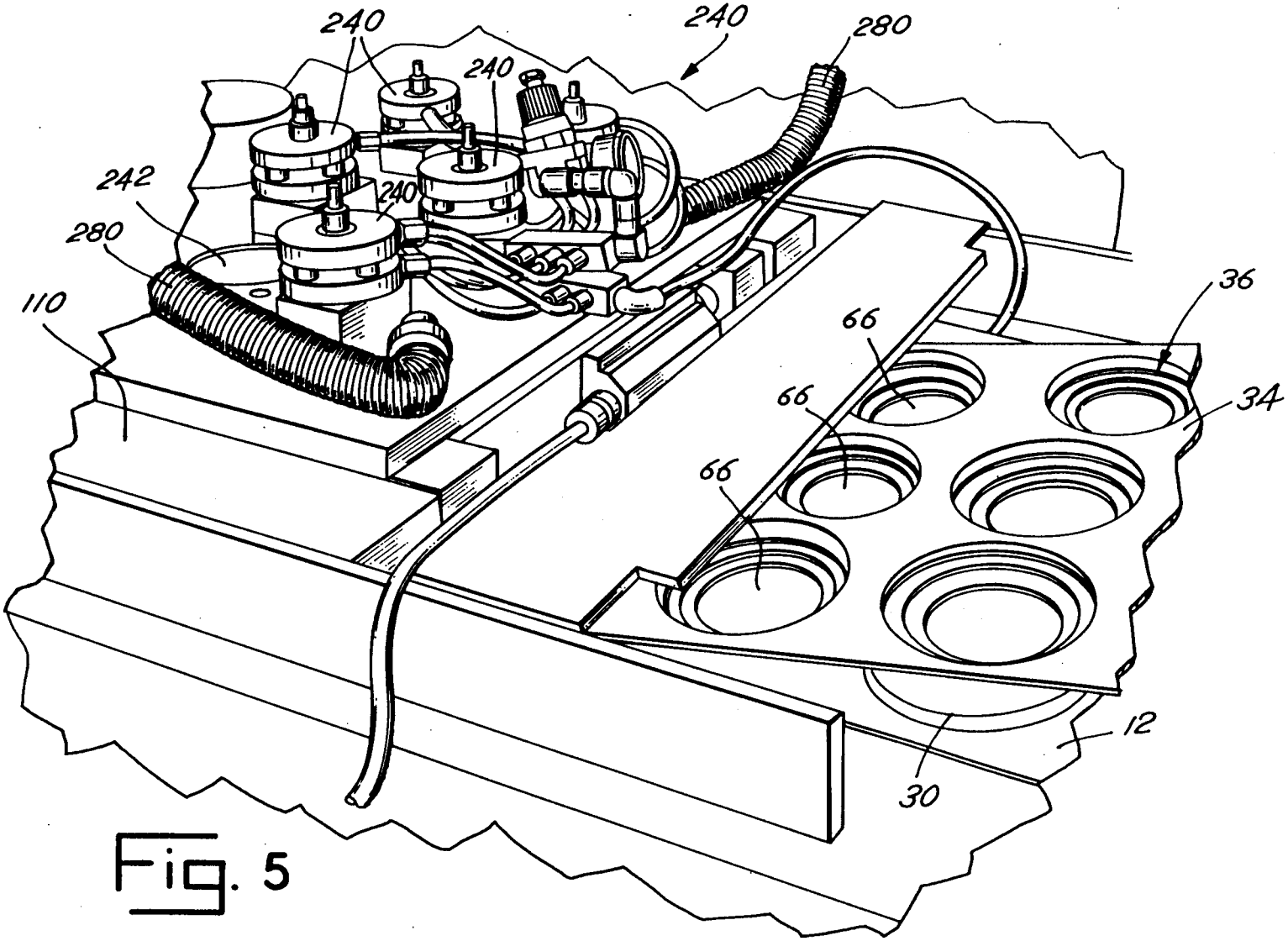
FIG. 5 is an enlarged, fragmentary, perspective view showing a portion of a seal and chill station of the apparatus of FIG. 1.
Figure 6:
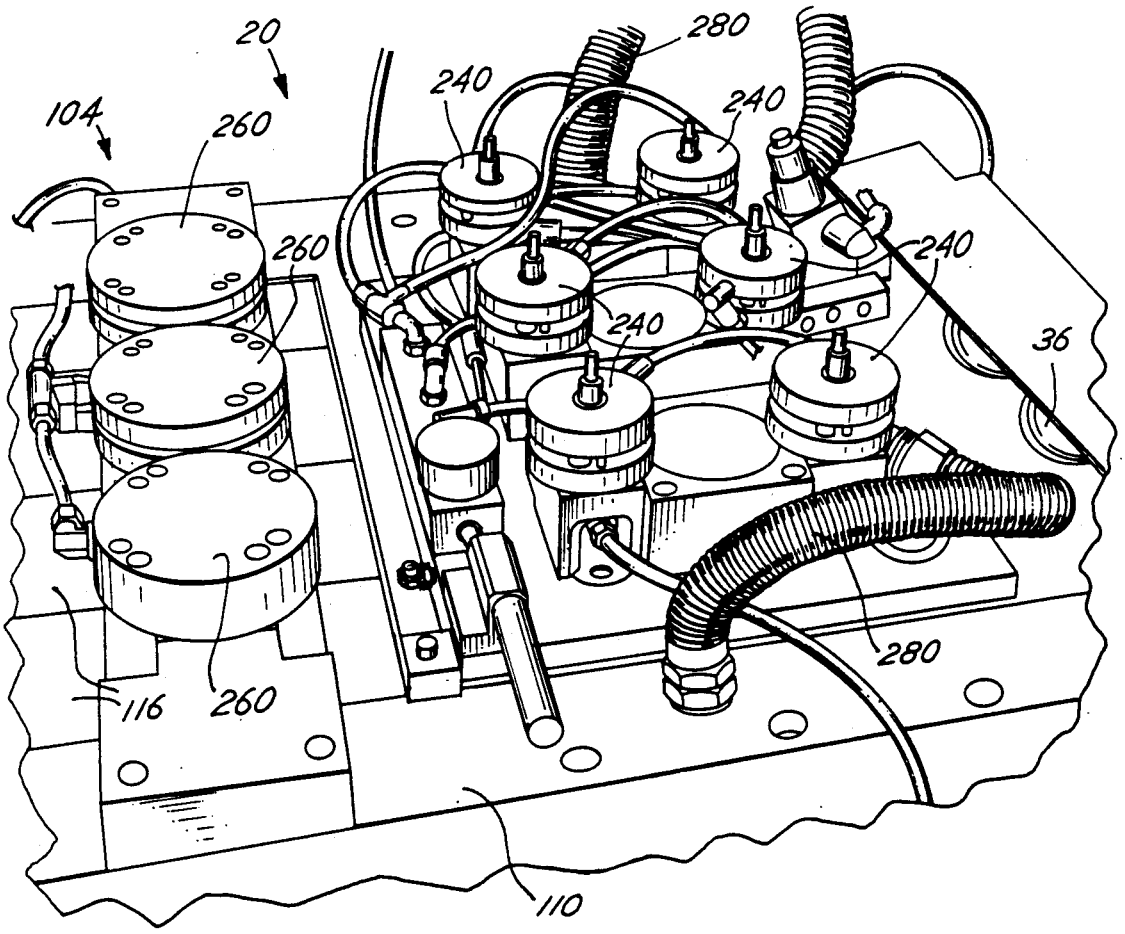
FIG. 6 is an enlarged, fragmentary, perspective view of the seal and chill station.

The tools of station 20, in a known manner, define a plurality of vacuum ports connected to a source of vacuum through lines 280 (FIGS. 5 and 6). Lower tool 114 defines a plurality of bores 282 within which are disposed web separators 284 (FIG. 8). As is known in the art, each web separator (FIG. 9) raises the top foil or web 34 away from the bottom container web 28 during the vacuumization process. Vacuum is drawn laterally across the surface of the tools through slits formed in portions of the web material 28 extending between the formed containers 30. If the web separators were not included, upper web 34 would close over the slit similar to the closing of a flapper valve and air would not be withdrawn from the container.

In the embodiment illustrated in FIG. 9, web separator 284 has a cartridge-like construction which is readily replaceable for maintenance purposes. Separator 284 includes an outer cartridge housing having a cylindrical shape 286. Housing 286 defines suitably formed bores 288 through which fasteners 290 extend to secure housing 286 to tool 114. Positioned within housing 286 is a plunger 292. A coil spring 294 biases plunger 292 downwardly or out of engagement with the upper web material. A flexible diaphragm 296 closes the bottom of housing 286. An air passage 298 in tool 114 is connected to a suitable source of pressurized air. In operation, a control system directs a source of pressurized air to passage 298. The air acting on diaphragm 296 raises plunger 292 against the bias of spring 294. Upon release of pressure within passage 298, the spring returns the plunger to its inoperative or lowered position.

FIG. 10 illustrates an alternative separator arrangement. Each separator 294' includes a lower plunger 302 actuated by a piston cylinder assembly 304. Plunger 302 sandwiches the upper web against a spring loaded plunger 306. Plunger 306 is slidably disposed on rod 308 and resiliently biased towards plunger 302 by a coil spring 310. As is known in the art, plungers 292 or 302 extend through slits formed in web material 28 to raise web material 36 in a tent-like fashion during the application of the vacuum to the chamber through the suitable vacuum apertures.

Figure 13:
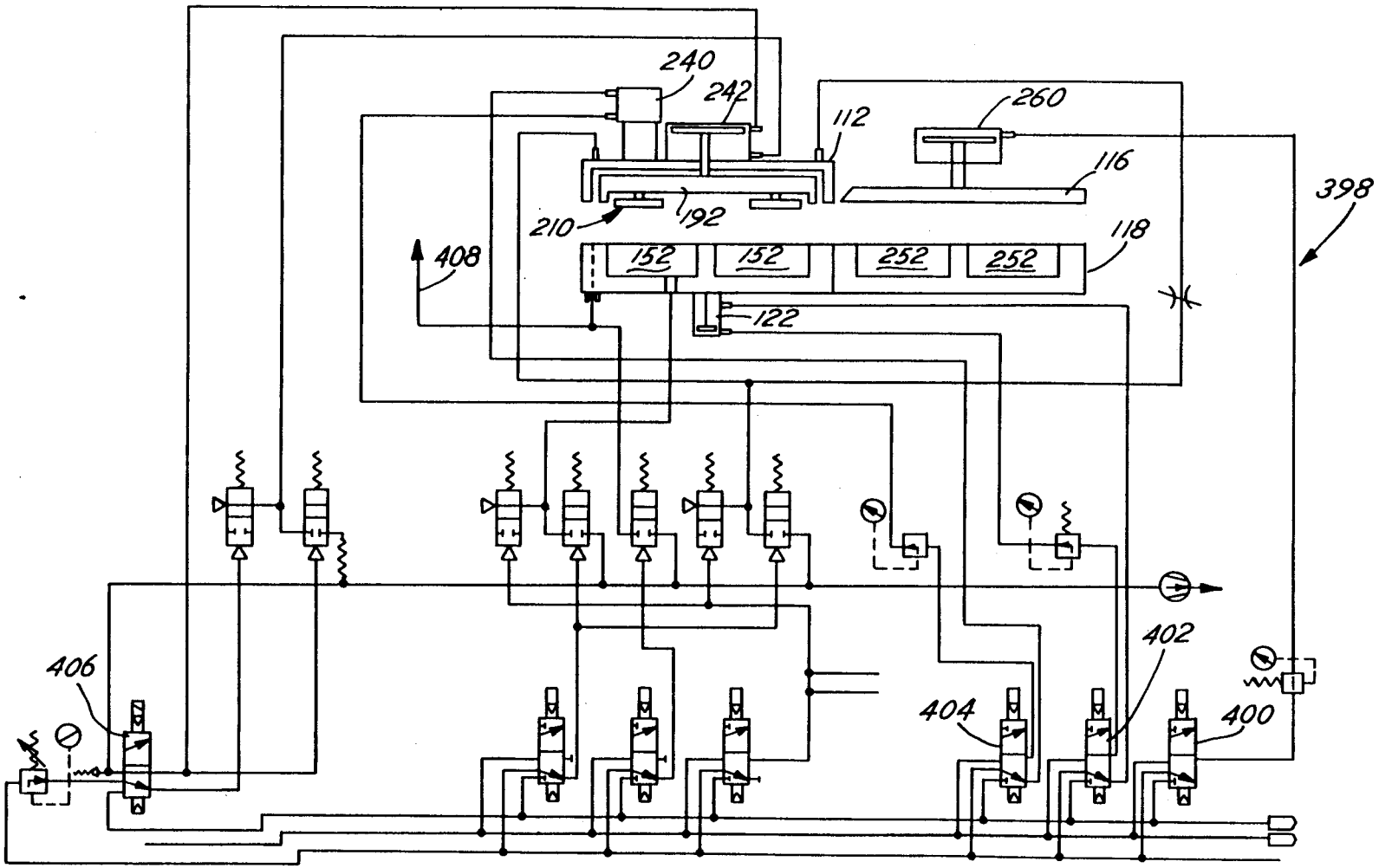
FIG. 13 is a schematic of a control system for use with the present invention.

A pneumatic control system 398 for operating the chill and seal station in accordance with the present invention is illustrated in FIG. 13. The control system includes a chill plate control valve 400, a web separator control valve 402 and a product sizing plunger cylinder control valve 404. In addition, a pressure and seal bar control valve 406 is included. The pneumatic control system is connected to a suitable control box through line 408. System 398 controls the sequence of operation of the various components of the seal and chill station in accordance with the timing chart of FIG. 14. The dotted lines in FIG. 14 indicate timing adjustment.

Operation

Initially, apparatus 10 is cycled to form the lower containers in web 12. Thermal forming station 18 forms the top or lid portions 36 in web 35. The comestible product is automatically or manually loaded into the lower containers 30 at station 16. The webs are advanced until two rows of products are positioned within the chill and seal station 20 (FIG. 12). At this point, lower tool 114 is moved vertically into sealing engagement with upper tool 102. The web separators are actuated. The plungers extend through slits formed in the web material 28 to raise the lid web material or foil 34 within the vacuum chamber defined by the upper and lower tools (FIG. 9). Vacuum is initially applied through suitable apertures in the tooling. The product sizing plunger is moved downwardly into engagement with the central circular portions 54 of each cover 36 while the container continues being vacuumized. The outer annular ring engages flange portions 62 which extend around the corrugations 66. Plunger 212 is configured so that its circular central portion fully engages circular central portion 64 of the lid or foil material. The plunger compresses the comestible product within the containers against the adjustable platform 160. If necessary, the platform may be adjusted vertically depending upon the type of product being packaged and its particular fit to the container to insure that there is a snug fit of product within the container. Plunger 212 in conjunction with platform 260 define the "compressed volume" of the product. The compression force is controlled by air pressure within piston cylinder actuator 240.

After application of the product sizing plunger but while it is still in engagement with the web material, the seal bar assembly is actuated to seal the upper web to the lower web or container. Subsequent to sealing, the chamber is vented.

Station 20 is opened to lower the tools 114, 118 and the webs are advanced another cutout zone. As a result, sealed product will be contained within chambers 52 of chill station 104 and unsealed product will be positioned within the chambers of the vacuum and sealing substation 102. During the vacuumizing and sealing operation, chill plate 116 is moved downwardly by piston cylinders 260 into engagement with the sealed area of the product within chambers 252.

Product is continuously advanced in stepwise fashion through station 20. After leaving station 20, the product is advanced to the cutoff station where the individual packages are separated from each other. Product is then discharged from the packaging machine.

The corrugations 66 in the lid portion 36 permit central area 64 to be moved towards or away from the product within container portion 30 under the action or against the bias of the plunger subassembly. The product sizing plunger accommodates or compensates for out of roundness of the product or variations in the height of the product stacked within the container. Since the product is compacted into the container, a close fit is achieved. This eliminates canning when the sealed container is exposed to atmospheric pressure. The occurrence of leakage is substantially reduced. In addition, the aesthetic appearance of the packaging is improved.

Alternative Seal Station

Figure 11:
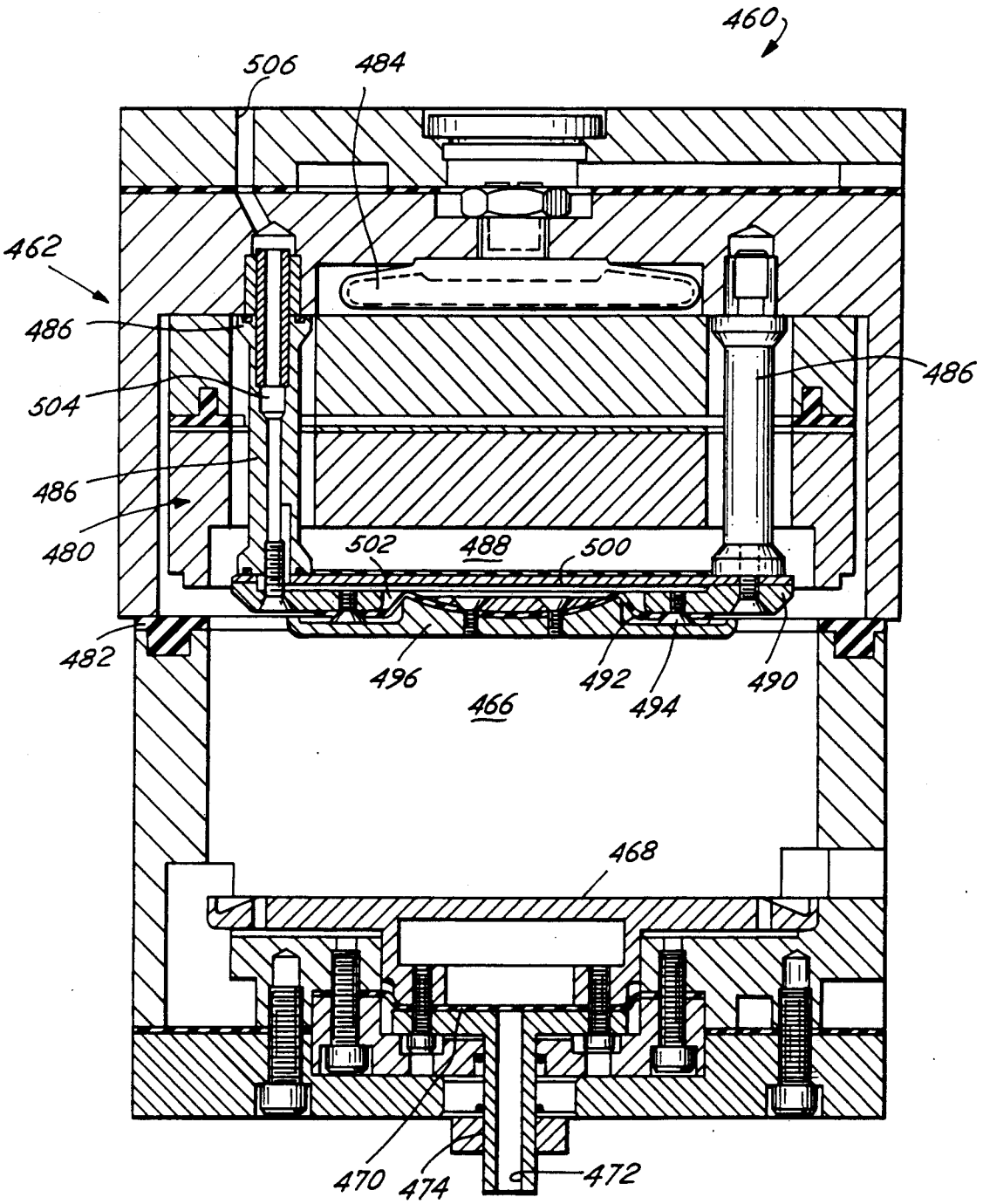
FIG. 11 is a cross-sectional, elevational view illustrating an alternative embodiment of a seal station in accordance with the present invention.

An alternative embodiment of the seal substation is illustrated in FIG. 11 and designated by the numeral 460. Alternative station 460 includes an upper tool 462 and a lower tool 464. Lower tool 464 defines a lower chamber 466. An adjustable platform 468 is disposed within chamber 466. In embodiment 460, platform 468 is secured to a flexible diaphragm 470. Platform 468 is spring biased to a lowered position by spring 472 which engages a nut 473 on a connector 474. Atmospheric pressure acting against diaphragm 470 will move platform 468 upwardly within chamber 466 when the chamber is connected to vacuum. An upper surface 470 of platform 468 is configured to conform to the bottom and lower peripheral edge of a container positioned within chamber 466.

Supported within upper tool 462 is a pressure and seal bar subassembly 480. Bar 480 is movable towards a resilient anvil or seal 482 by a pressurized bladder 484. Support rods 486 are carried by tool 462 and extend into an upper chamber 488. An annular ring 490 is secured to the lower ends of rods 486. A flexible diaphragm 492 is secured to ring 490 by suitable fasteners 494. A product sizing plunger plate 496 is secured to diaphragm 492. Also carried by support post 486 is a circular plate 500. Plate 500 and diaphragm 492 define a chamber 502. Chamber 502 is connected to a source of pressurized air through a passage 504 in one of the support posts 486 in a passage 506 defined by tool 462.

Operation of the alternative embodiment 460 is similar to the preferred embodiment described above. The tools are initially opened and the two webs are placed in register. The tools are closed. The vacuum is applied in a conventional fashion. Platform 468 is moved against the bottom of the container by the atmospheric pressure. Diaphragm 470 acts as the platform adjustment means which varies the volume of chamber 466. Product sizing plunger 496 is moved downwardly by compressed air entering passage 506. The seal bar subassembly 480 is then moved into contact with the web through pressurization of bladder 484.

The vacuum and seal station in accordance with the present invention eliminates canning and product leakage problems heretofore experienced The tooling readily accommodates variations in product diameter and/or height as well as variations in the container dimensions. The comestible product is compacted or compressed within the container assuring a snug fit. Buckling or canning of the container is substantially eliminated, thereby eliminating stress fractures in the rigid container material. An aesthetically pleasing package is produced and the occurrence of leakers is substantially reduced.

In view of the foregoing description, those of ordinary skill in the art may envision various modifications which will not depart from the inventive concepts disclosed herein. It is therefore intended that the above description should be considered as that of the preferred embodiments. The true spirit and scope of the present invention may be determined by reference to the appended claims.

The embodiments of the invention in which an exclusive property or privilege is claimed are defined as follows:

1. A vacuum package machine comprising:

a main frame;

a container forming station carried by said frame;

container web supply means for continuously supplying a first continuous web of rigid polymeric material to said container forming station;

a refrigerated food product loading station means carried by said frame for loading a refrigerated food product into the containers continuously formed at said container forming station;

a lid forming station carried by said frame;

lid web supply means for continuously supplying a second continuous web of rigid polymeric material to said lid forming station;

a vacuum seal and sizing station including a vacuum chamber, means to create vacuum in said chamber, product deformation, conformation and lateral and vertical sizing means in said chamber for deforming in both the lateral and vertical directions the refrigerated food product which has been loaded into the containers formed in said first continuous web of rigid polymeric material to conform the refrigerated food product into substantially snug disposition both laterally and vertically with the containers;

said product deformation, conformation and sizing means comprising application, registration and pressing means for continuously applying said lids formed in said second continuous web of rigid polymeric material in registry with and atop said filled containers formed in said first continuous web of rigid polymeric material, and for pressing central portion of each lid formed in said second continuous web of rigid polymeric material against the product contained in said containers found in said first continuous web of rigid polymeric material to laterally and vertically size the product;

peripheral sealing and pressing means movable relative to said lid application means for application of heat to seal and press together said first continuous web of rigid polymeric material and said second continuous web of rigid polymeric material only at the regions thereof which are exterior of each container filled with the refrigerated food product and registered lid applied thereover thereby avoiding the application of heat in the center of the lid and the refrigerated product, while simultaneously maintaining said second continuous web of rigid polymeric material at the respective regions of the lids formed therein in pressing contact with the refrigerated food product contained within said containers formed in said first continuous web of rigid polymeric material; and individual package cutting means for cutting through both the first continuous web of rigid polymeric material and the second continuous web of rigid polymeric material around the sealed together filled container and the pressingly disposed lid to cut free from said first and second continuous webs of rigid polymeric material individual sealed packages of sized product.

2. The vacuum package machine of claim 1 wherein said lid forming means is disposed downstream said container forming means.

3. The vacuum packaging machine of claim 1 wherein said lid forming means and said container forming means are disposed in spaced array.

4. The vacuum packaging machine of claim 1 wherein said product loading station is disposed downstream of said container forming station.

5. The vacuum packaging machine of claim 1 wherein said product sizing means comprises:

a plunger defining said surface; and a plunger actuator connected to said plunger for moving said plunger towards said container chamber.

6. The vacuum packaging machine of claim 2 wherein said plunger actuator comprises a piston/cylinder assembly including a rod extending into said upper chamber, said rod being secured to said plunger.

7. The vacuum packaging machine of claim 6 wherein said product compression and lateral and vertical sizing means further includes:

a cup-shaped plate having an annular edge extending around the periphery of said plunger; and spring means engaging said cup-shaped plate and resiliently biasing said plate towards said lower chamber.

8. The vacuum packaging machine of claim 1 further including a web separator on said lower tool.

9. The vacuum packaging machine of claim 7 further including a web separator on said lower tool.

10. The vacuum packaging machine of claim 1 wherein said platform adjustment means comprises:

a lead screw rotatably supported on said lower tool;

a follower threaded onto said lead screw and engaging said platform; and lead screw actuator means for rotating said lead screw.

11. The vacuum packaging machine of claim 9 wherein said platform adjustment means comprises:

a lead screw rotatably supported on said lower tool;

a follower threaded onto said lead screw and engaging said platform; and lead screw actuator means for rotating said lead screw.

12. The vacuum packaging machine of claim 1 wherein said platform adjustment means comprises:

a flexible diaphragm connected to said platform and having a side exposed to atmospheric pressure.

13. The vacuum packaging machine of claim 1, wherein said sealing means being located in a sealing station and comprising a lower tool defining a plurality of spaced container chambers, said lower tool including a bottom, sidewalls and interior chamber walls;

an upper tool defining an upper chamber, said upper chamber and said lower chamber defining a vacuum chamber;

a plurality of platforms, each platform being disposed within one of said container chambers, said platforms each defining an upper container contacting surface;

wherein said compression and lateral and vertical sizing means extend into said container chambers for compacting the product within the containers to effectuate snug disposition of the product both laterally and vertically within the container before the cover web is sealed to the containers; and a sealing bar within said vacuum chamber.

14. The vacuum packaging machine of claim 13 wherein said product compression and lateral and vertical sizing means comprises:

a plurality of plungers, each plunger being coaxial with and disposed within one of said container chambers, each of said plungers defining a product engaging surface;

actuating means engaging said plungers for moving said plungers towards said platform to compress and compact product within said containers such that said containers are supported by the product and the container chamber walls.

15. The vacuum packaging machine of claim 14 wherein said actuating means comprises a plurality of piston/cylinder assemblies mounted on said upper tool, each assembly including a rod secured to one of said plungers.

16. The vacuum packaging machine of claim 14 wherein said product engaging surface of each of said plungers has a stepped cross-sectional configuration.

17. The vacuum packaging machine of claim 15 wherein said product engaging surface of each of said plungers has a stepped cross-sectional configuration.

18. The vacuum packaging machine of claim 13 further including:

platform adjustment means connected to said platforms for adjustably positioning said platforms within said container chambers thereby permitting the volume of said vacuum chamber to be adjusted.

19. The vacuum packaging machine of claim 1, said vacuum station comprising:

upper and lower tools defining a vacuum chamber;

sealing means within said chamber for sealing a first web to a second web defining a container; and wherein said compression and lateral and vertical sizing means within said chamber compacts a comestible product disposed within said container to thereby reduce free air space prior to sealing of said first web and to accommodate variations in the dimensions of said comestible product.

20. The vacuum packaging machine of claim 19 wherein said product compression and lateral and vertical sizing means comprises:

a product sizing plunger within said chamber; and actuator means connected to said plunger for moving said plunger into engagement with the comestibles food product.

21. The vacuum packaging machine of claim 19 wherein said product compression and lateral and vertical sizing means includes:

a platform disposed within said chamber and positioned to engage and undersurface of said container; and platform adjustment means connected to said platform for adjustable positioning said platform within said chamber to vary effective chamber volume and to accommodate container size variations.

22. The vacuum packaging machine of claim 21 wherein said product compression and lateral and vertical sizing means further includes:

a product sizing plunger within said chamber; and actuator means connected to said plunger for moving said plunger into engagement with the comestibles food product.

23. The vacuum packaging machine of claim 20 wherein said product compression and lateral and vertical sizing means further comprises:

an annular cup having a rim extending around the periphery of said plunger; and resilient means engaging said cup for resiliently biasing said cup towards said container.

24. The vacuum packaging machine of claim 22 wherein said product compression and lateral and vertical sizing means further comprises:

an annular cup having a rim extending around the periphery of said plunger; and resilient means engaging said cup for resiliently biasing said cup towards said container.

25. The vacuum packaging machine of claim 19 wherein said station further includes a chill substation, said chill substation comprising:

a lower chill tool defining a container chamber;

an upper chill plate;

cooling means connected to said plate for cooling said plate; and chill plate actuating means operatively connected to said chill plate for moving said chill plate towards said lower chill tool.

26. The vacuum packaging machine of claim 22 wherein said station further includes a chill substation, said chill substation comprising:

a lower chill tool defining a container chamber;

an upper chill plate;

cooling means connected to said plate for cooling said plate; and chill plate actuating means operatively connected to said chill plate for moving said chill plate towards said lower chill tool.

27. A method of vacuum packaging a comestibles product comprising the steps of:

forming a container from a first continuous web of rigid polymeric material;

placing a refrigerated comestibles product within the container;

forming a lid from a second continuous web of rigid polymeric material disposed in spaced relationship with the formed container, said lid having a peripheral flange, a central portion and flexible means connecting the central portion to said flange:

placing said lid in registry with said container;

positioning said lid and said container within a vacuum chamber;

compressing said refrigerated comestibles product within said container to deform said product laterally and vertically to eliminate free air space both laterally and vertically by engaging the central portion of said lid which is disposed on contact with the refrigerated comestibles product;

vacuumizing said chamber while retaining in substantially non-collapsed array the as formed structures of both the container and the lid respectively formed of such rigid polymeric materials; and compressing and applying heat for sealing said lid to said container only in areas exteriorly of the refrigerated comestibles product with substantial avoidance of heat at the central portion of said lid, thereby to avoid substantial application of heat to the comestibles product.

28. The method of claim 27 further including the step of:

cooling said lid and said container.

29. The method of vacuum packaging a comestibles product as claimed in claim 27 and wherein the container and the lid are continuously formed.

30. A vacuum seal and sizing station for use in a vacuum packaging machine to vacuum seal a compressible product with a container, said station comprising:

an upper tool defining an upper chamber;

a lower tool defining a container chamber having a peripheral edge;

a resilient anvil extending around the peripheral edge of said container chamber, said chambers being movable towards and away from each other;

a pressure and sealing bar disposed with said upper chamber;

pressure and sealing bar actuating means on said upper tool and engaging said bar for moving said bar towards said resilient anvil;

a platform disposed within said container chamber;

platform adjustment means operatively connected to said platform for adjustable positioning said platform to permit the volume of said lower chamber to be varied;

a product sizing means carried by said upper tool and having a surface disposed within said upper chamber and which is movable towards said lower chamber for compressing a product within a container within said container chamber;

a web separator on said lower tool, wherein said web separator comprises:

a cartridge housing having a sidewall and a base, said base defining a separator plunger aperture;

a plunger disposed within said housing and extending through said aperture;

a diaphragm engaging said plunger;

a passage in said lower tool and communicating with said diaphragm; and a spring within said housing for biasing said plunger away from said aperture.

31. A vacuum seal and sizing station for use in a vacuum packaging machine to vacuum seal a compressible product with a container, said station comprising:

an upper tool defining an upper chamber;

a lower tool defining a container chamber having a peripheral edge;

a resilient anvil extending around the peripheral edge of said container chamber, said chambers being movable towards and away from each other;

a pressure and sealing bar disposed within said upper chamber;

pressure and sealing bar actuating means on said upper tool and engaging said bar for moving said bar towards said resilient anvil;

a platform disposed within said container chamber;

platform adjustment means operatively connected to said platform for adjustable positioning said platform to permit the volume of said lower chamber to be varied;

a product sizing means carried by said upper tool and having a surface disposed within said upper chamber and which is movable towards said lower chamber for compressing a product within a container within said container chamber, wherein said product sizing means comprise;

a plunger defining said surface; and a plunger actuator connected to said plunger for moving said plunger towards said container chamber wherein said plunger actuator comprises a piston/cylinder assembly including a rod extending into said upper chamber, said rod being secured to said plunger;

a cup-shaped plate having an annular edge extending around the periphery of said plunger;

spring means engaging said cup-shaped plate and resiliently biasing said plate towards said lower chamber; and a web separator on said lower tool, wherein said web separator comprise;

a cartridge housing having a sidewall and a base, said base defining a separator plunger aperture;

a plunger disposed within said housing and extending through said aperture;

a diaphragm engaging said plunger; a passage in said lower tool and communicating with said diaphragm; and a spring within said housing for biasing said plunger away from said aperture.

* * * * *